US007094089B2

(12) United States Patent
Andre et al.

(10) Patent No.: US 7,094,089 B2
(45) Date of Patent: Aug. 22, 2006

(54) DC CONNECTOR ASSEMBLY

(75) Inventors: Bartley K. Andre, Menlo Park, CA (US); Jonathan P. Ive, San Francisco, CA (US); Jong Min Lee, San Francisco, CA (US); Kan Lim, Sunnyvale, CA (US)

(73) Assignee: Apple Computer, Inc., Cupertino, CA (US)

( * ) Notice: Subject to any disclaimer, the term of this patent is extended or adjusted under 35 U.S.C. 154(b) by 0 days.

(21) Appl. No.: 10/799,403

(22) Filed: Mar. 12, 2004

(65) Prior Publication Data

US 2005/0202727 A1 Sep. 15, 2005

(51) Int. Cl.
*H01R 21/00* (2006.01)

(52) U.S. Cl. ..... 439/218; 439/607

(58) Field of Classification Search ..... 439/607, 439/609, 218, 217, 954, 221, 222, 223, 660
See application file for complete search history.

(56) References Cited

U.S. PATENT DOCUMENTS 5,295,843 A * 3/1994 Davis et al. ..... 439/108
5,380,225 A * 1/1995 Inaoka ..... 439/660
5,785,557 A * 7/1998 Davis ..... 439/660
6,439,928 B1 * 8/2002 Akama et al. ..... 439/608
6,482,045 B1 * 11/2002 Arai ..... 439/680
6,530,793 B1 * 3/2003 Eichhorn et al. ..... 439/218
2001/0053630 A1 * 12/2001 Shi et al. ..... 439/607
2005/0124217 A1 * 6/2005 Zhuang et al. ..... 439/607
2005/0124218 A1 * 6/2005 Chen et al. ..... 439/607
2005/0124219 A1 * 6/2005 Chen et al. ..... 439/607

* cited by examiner

*Primary Examiner*—Ross Gushi
(74) *Attorney, Agent, or Firm*—Beyey Waever & Thomas LLP

(57) ABSTRACT

A DC connector arrangement is disclosed. The DC connector arrangement includes a DC plug and a DC receptacle that are configured to engage one another at more than one position. The DC plug and DC receptacle are also configured with a small contact distance to minimize the insertion and extraction forces that occur between the DC plug and the DC receptacle.

35 Claims, 6 Drawing Sheets

DC CONNECTOR ASSEMBLY

FIELD OF THE INVENTION

The present invention relates to apparatus and methods for powering electronic devices. More particularly, the present invention relates to improved techniques for DC connections.

BACKGROUND OF THE INVENTION

In order to operate and/or charge electronic devices, dedicated power assemblies that connect the electronic devices to external power sources are required. Power assemblies generally include a plug that receives AC current from an electrical outlet, a power converter that turns AC current into DC current, and a power plug that distributes the DC current through a power port of the electronic device. As is generally well known, DC current (3 to 12 volts and less than 1 amp of current) is required to operate most electronic devices and to recharge batteries that store DC current while AC current (110 volts or 220 volts) is typically supplied in most buildings.

AC connections, such as the American standard for alternating current, come in various configurations including two prong or three prong connections. In either case, the prongs include at least a two metal contacts for carrying AC current. Three prong connections additionally include a "ground" contact that provides a path to ground when an electrical failure occurs. In the two prong variety (unless it includes one oversized prong), the two metal contacts are electrically identical and therefore their positions may be reversed when connecting to an AC socket. For example, the two prong AC connector can be inserted up or down (two ways to insert). In the three prong variety, the three metal contacts typically must be inserted in one position relative to the socket (only one way to insert).

DC connections also come in various configurations. The most common DC connection includes a post that slides axially into a jack. Both the post and the jack typically include an outer and inner contact. Because they connect axially, these connections typically do not require an exact connection position as the AC connections (e.g., 0 to 360 degree insertion). The post fits snuggly into the jack so that a friction force holds the two together, i.e., resists sliding motion. In order to ensure proper electrical contact and securement between the post and the jack, high friction is typically required over a long distance. This is especially true at the outer contact. Unfortunately, however, this makes it difficult to insert and extract the post to and from the jack. That is, a large insertion or extraction force over a large distance is necessary in order to couple and decouple the post from the jack. Furthermore, the post must move parallel to the centerline of the jack (axially). If the plug is pulled or pushed at a slight angle relative to the central axis, the force required to extract or insert the plug goes up exponentially.

A less common DC connection includes plug/outlet combination similar to the AC connection. This type of DC connection includes a plug having female sockets, and an outlet having male pins. The entire plug is insertable into the outlet in order to allow the mating of the pins and sockets. This type of connection can only be mated one way. In fact, in order to ensure that the plug is correctly positioned within the outlet, the plug may include a protrusion that fits into a groove in the outlet Other DC connections may also be provided by connectors that include both power and data functionality. These type of connectors typically include a linear array of pins or pads. Each pin or pad is dedicated to transmitting power or data. Similarly to the large two prong or three prong AC connection and the less common DC connection described above, these type of connections can only be connected one way. In fact, the mating connectors typically include arrows or visual indicators for correctly aligning the two connectors so that they are placed in the appropriate position for mating. In addition, linear array connectors generally include a button or latch mechanism for securing the connectors together (rather than using friction). While these mechanisms may work well, they add complexity and cost to the connector. Furthermore, because they are mechanical in nature they can break over time (repeated use) and some users may have difficulty manipulating the buttons or latches. Moreover, the buttons and latches may adversely affect the cosmetic appearance of the connector (e.g., protrusions), especially on the plug side of the DC connection. As should be appreciated, the plug side is the side that is typically seen by the user and thus poor aesthetic qualities may cause the user to think badly about the product in which it is used.

In view of the above, what is desired is an improved DC connector assembly that is easy to insert and extract.

SUMMARY OF THE INVENTION

The invention relates, in one embodiment, to a DC connector. The Dc connector include an outer shell. The DC connector also includes an inner electrode disposed within the outer shell. The inner electrode includes redundant power contacts that are electrically isolated within the same plane. The redundant power contacts are laterally spaced apart equally relative to a central axis.

The invention relates, in another embodiment, to a DC connector arrangement. The DC connector arrangement includes a DC receptacle having an outer conductor and an inner electrode disposed within the outer conductor. The DC connector arrangement also includes a DC plug having an outer conductor that electrically mates with the outer conductor of the DC receptacle and an inner electrode disposed within the outer conductor and that electrically mates with the inner electrode of the DC receptacle. The inner electrodes of both the DC plug and DC receptacle include juxtaposed contacts. The juxtaposed contacts include a center contact and lateral redundant contacts that are equally spaced from the center contact. The center contact of the DC plug is configured to mate with the center contact of the DC receptacle and the lateral redundant contacts of the DC plug are configured to mate with either of the lateral redundant contacts of the of the DC receptacle.

The invention relates, in another embodiment, to a DC connector arrangement. The DC connector arrangement includes a DC receptacle. The DC connector arrangement also includes a DC plug insertable into the DC receptacle. The DC connector arrangement further includes a holding detent mechanism located between the DC receptacle and DC plug. The holding detent mechanism minimizes the distance the plug has to travel relative to the receptacle at the friction force required to hold the plug in the receptacle during normal use.

The invention relates, in another embodiment, to a DC connector assembly. The DC connector assembly includes a DC receptacle having a receiving element. The DC connector assembly also includes a DC plug having an insertion element that both mechanically and electrically couples to and decouples from the receiving element. The coupling between the insertion element and receiving element allowing DC power transmissions to occur between the DC plug and the DC receptacle. The insertion element is configured for only 0/180 degree insertion into the receiving element while providing the same functionality from both positions. The insertion and receiving elements have a small axial contact distance between about 3 and about 4 mm in order to minimize the insertion extraction force found between the insertion and receiving elements. The receiving element includes a plurality of contacts that coincide exactly with a plurality of contacts located on the insertion element. At least a portion of the corresponding contacts are power contacts for allowing DC power transmission to occur between the DC receptacle and DC plug.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

In electronic devices such as portable computers, the trend of thinner, lighter and powerful presents a continuing design challenge in the design of DC power connections. The design challenge generally arises from the desire to produce small and durable connections while still providing proper electrical contact, proper holding power during use, minimized insertion and extract forces, and easy connectability.

The invention generally pertains to DC connectors including DC plugs and DC receptacles. One aspect of the invention relates to DC plugs that are capable of being inserted into DC receptacles at two positions as for example 0 and 180 degrees (even though the electrical contacts are not electrically identical). Another aspect of the invention relates to DC plugs and receptacles with optimized insertion and extraction forces. The insertion and extract forces may be optimized by minimizing the distance the plug has to travel relative to the receptacle and including retaining features that provide the nominal force needed to hold the plug in the receptacle during normal use. Another aspect of the invention relates to DC plugs that are more robust. Yet another aspect of the invention relates to DC plugs and receptacles having thin profiles that can be used in thin electronic devices such as portable computers.

Embodiments of the invention are discussed below with reference to FIGS. 1–6. However, those skilled in the art will readily appreciate that the detailed description given herein with respect to these figures is for explanatory purposes as the invention extends beyond these limited embodiments.

Figure 1:
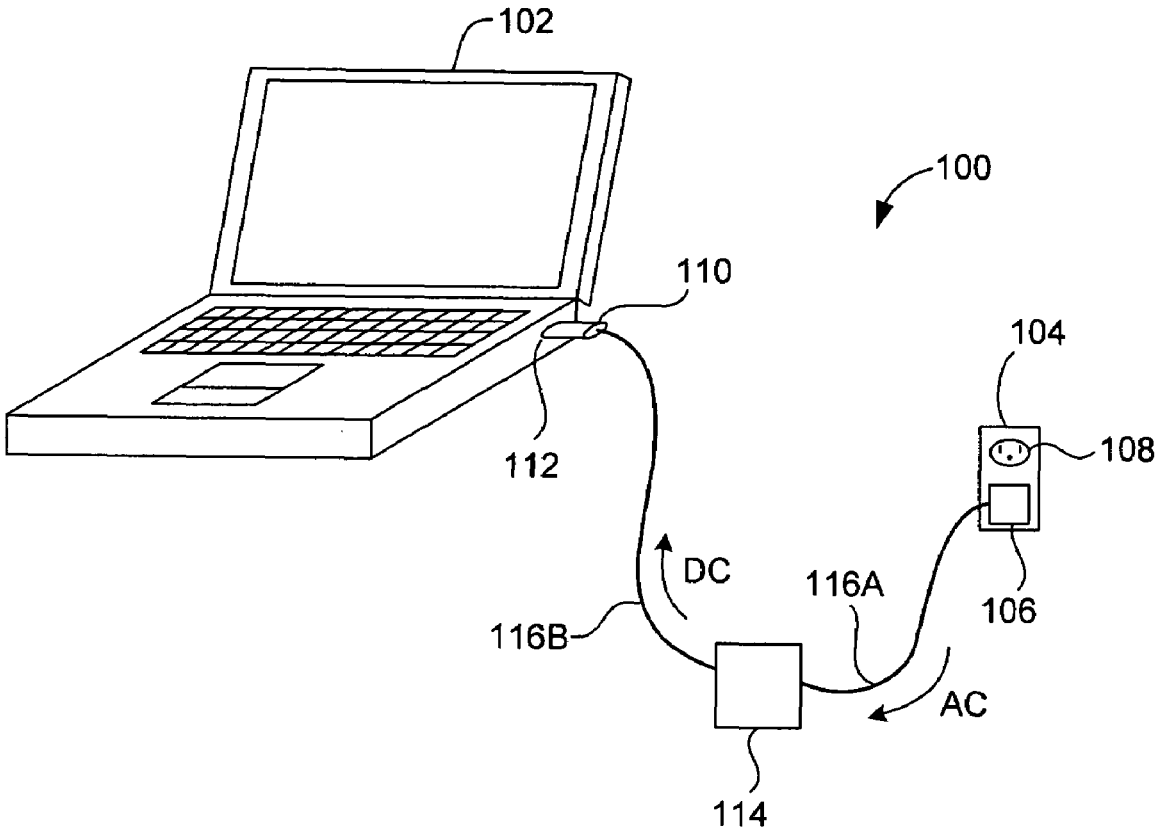
FIG. 1 is a diagram of a power adapter, in accordance with one embodiment of the present invention.

FIG. 1 is a diagram of a power adapter 100, in accordance with one embodiment of the present invention. The power adapter 100 helps provide power to an electronic device 102 during operation and charging thereof. The electronic device may for example be a portable device such as a laptop computer (as shown), PDA, camera, music player, and the like. The power adapter 100 is configured to receive a first power from a power source 104 and to output a second power to the electronic device 102. The first and second powers may be similar or different. The power source may for example be a conventional electric outlet that supplies AC current, a car lighter outlet that supplies DC current, or the like. The power adapter 100 is generally configured to output the required or known power to the electronic device 102. As should be appreciated, each electronic device 102 requires a particular type and amount of power in order to operate. In most cases, the electronic device requires a DC current and therefore the power adapter is configured to output a DC current.

In the illustrated embodiment, the power adapter 100 is configured to receive AC power and to output DC power. The DC power may be used to indirectly charge a battery contained within the electronic device or to directly power the electronic device. As shown, the power adapter 100 includes an AC plug 106 that is inserted into a conventional AC socket 108. The AC connection may for example correspond to a two or three prong plug/socket associated with various electrical standards including but not limited to U.S., Japan, UK, France, Italy, Germany, Spain, Sweden and the like. The power adapter 100 also includes a DC plug 110 that is inserted into a DC receptacle 112 contained within the electronic device 100. The DC receptacle is connected to the internal processing components of the electronic device, and may be controlled by a power management circuit. Each of the plugs 106 and 110 is electrically connected to one another through a power converter 114 and power cables 116A and 116B. The power converter 114 is configured to convert the source power (104) into a power that is required for operating or charging the electronic device 100. Although not shown, the power converter 114 may include a rectifier for converting the alternating current to direct current and/or a transformer for converting the electrical power form one voltage-current level to another voltage-current level. By way of example, the power converter may convert about 100 to about 240 volts AC, to about 0 to 50 volts DC and 0 to about 3 amps. In one particular configuration, the power converter converts any AC power to about 24.5 volts and 2.65 amps.

The power converter 114 may also include an identification circuit for helping determine the type of AC power being supplied, and the DC power requirement of the electronic device attached thereto. That is, the identification circuit identifies the AC power coming from the power supply and the DC power required to operate the electronic device. As should be appreciated, both the supplied AC power and required DC power may be widely varied. As mentioned previously, AC power typically comes in 110 V and 220 V and the DC power requirement can vary from electronic device to electronic device (e.g., approximately 3 to 50 volts and 0.5 to 3 amps). In one embodiment, the identification circuit communicates with the electronic device in order to determine the DC power requirement, and monitors (detects or senses) the power source in order to determine the AC source power. Once known, the power converter can make the necessary adjustments, i.e., convert the source AC power into the required DC power. By way of example, the identification circuit may include an onboard controller that is attached to a printed circuit board.

Moreover, the power converter may include various capacitors, resistors and the like. Capacitors may for example produce a more steady state current. The power converter may additionally include heat transfer mechanisms such as heat sinks and insulators, which provide cooling to the components enclosed therein. In some cases, the power converter may even be configured to receive additional inputs including other power inputs as well as data inputs (e.g., Firewire, USB, network, etc.).

Figure 2A:
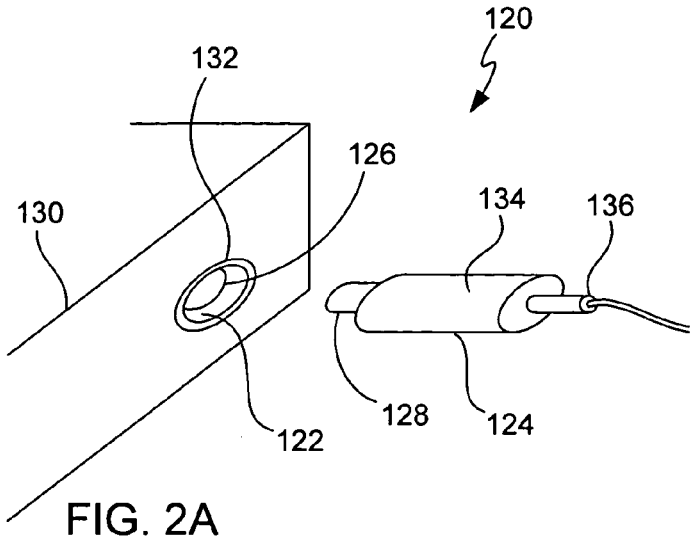
FIGS. 2A–2C are perspective diagrams of a DC connector assembly, in accordance with one embodiment of the present invention.
Figure 2B:
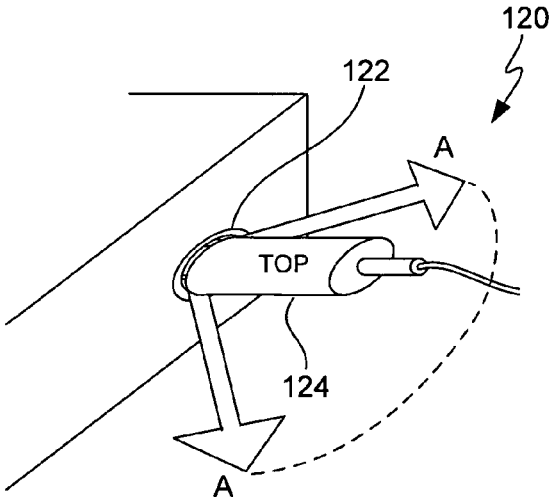
Figure 2C:
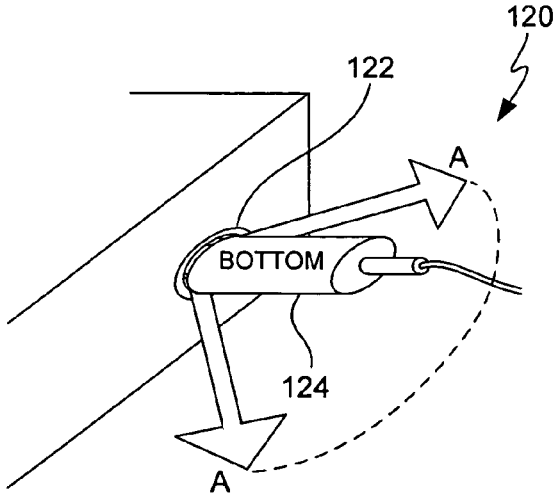

FIGS. 2A–2C show a DC connector assembly 120, in accordance with one embodiment of the present invention. By way of example, the DC connector assembly may generally correspond to the DC connection shown in FIG. 1. The DC connector assembly 120 generally includes a DC receptacle 122 and a DC plug 124 for insertion into the DC receptacle 122 (FIGS. 2B and 2C). As shown in FIG. 2A, the DC receptacle 122 includes a receiving element 126 and the DC plug 124 includes an insertion element 128 that both mechanically and electrically couples to and decouples from the receiving element 126. Although the size and shape of the insertion and receiving elements are similar to ensure mating engagement, it should be noted that they may be widely varied. In most cases, the height is kept small compared to the width, i.e., the height of the connector is less than the width of the connector, so that the DC connection assembly 120 can be used in thin electronic devices.

The DC receptacle sits inside a housing 131 of an electronic device 130 and is accessed through an opening 132 in the housing 131 of the electronic device 130. The receiving element 126 is electrically connected to the appropriate internal circuitry stored inside the housing 131 of the electronic device 130. The insertion element 128, on the other hand, is disposed inside its own enclosure 134 and is electrically connected to a power source, which is located externally relative to the electronic device 130. The insertion element 128 may be electrically connected to the power source through a power converter and one or more cables as shown in FIG. 1.

The enclosure 134 is configured to surround and protect the electrical connection between the insertion element 128 and a cable 136. The enclosure 134 also provides a means for grasping the DC plug 124 when the DC plug 124 is inserted and extracted to and from the DC receptacle 122. The enclosure 134 makes the DC plug 124 more ergonomic since the insertion element 128 is relatively small and therefore hard to manipulate by itself. By way of example, the insertion element 128 may have a cross sectional size on the order of 4.25×8 mm, while the enclosure 134 may have a cross sectional size on the order of 6.5×10 mm.

Both the receiving element 126 and insertion element 128 include a variety of corresponding electrical contact regions. When the plug 124 is inserted in the receptacle 122, the contact regions electrically connect thereby allowing electrical transmission to occur between the DC plug 124 and the DC receptacle 122. The electrical contact regions include at least two power contact regions: one for delivering power (hot), the other for returning power (ground). The electrical contact regions may additional include a data contact region (s).

The electrical contact regions may be widely varied. In one implementation, both the receiving and insertion element include mating outer shells and mating inner electrodes. The outer shell serves as a connection point for one of the critical power lines, and the inner electrode serves as the connection point for the other critical power line and possibly one or more data lines. In some cases, the outer shell is coaxially placed relative to the inner electrode. In general, both the shells and the electrodes include one or more contacts. When there are plural contacts, the contacts are typically juxtaposed or positioned laterally relative to one another. For example, the contacts may be configured as a linear array of pins or pads. This arrangement works well in flat or elongated connectors required by thin electronic devices.

In one embodiment, the insertion element is configured for 0/180 degree insertion into the receiving element while providing the same functionality from both positions. That is, the plug 124 may be inserted face up as shown in FIG. 2B or face down as shown in FIG. 2C while still providing the same functionality (still providing the correct contact for power and/or data transfer). This is generally accomplished by providing redundant contacts at the electrical contact regions. By redundant it is generally meant that the contacts perform the same function. The redundant contacts may be used for data, power and the like. For example, the redundant contacts may be dedicated to transmitting the same data, the same driving current, or the same returning current. In general, the redundant contacts are placed equal lateral distances from the centerline of receiving or insertion element. By way of example, the receiving and insertion element may include a linear array of contacts that have the same pin layout on both sides of the centerline. In one embodiment, at least one of the critical power contact regions includes redundant power contacts. In another embodiment, both of the two critical power contact regions include redundant contacts. 0/180 degree insertion is also accomplished with receiving and insertion elements having cross sectional shapes that are 0/180 symmetrical. That is, the elements are symmetrical on opposites sides of the major and minor axes, as for example, rectangles, ovals (ellipses) and the like. Other modified shapes such as elongated hexagons and elongated octagons may be used.

In another embodiment, the axial contact distance D between the receiving element 126 and insertion element 128 is made small in order to reduce the insertion and extraction force needed for inserting and extracting the plug 124 into and out of the receptacle 122. The user can simply slide the plug 124 into the receptacle 122 without having to use undo force. The axial contact distance D is the length of the insertion element 128 that actually contacts the receiving element 126. As should be appreciated, the greater the length, the greater the force needed for coupling and decoupling (as the connectors are typically dimensioned with very tight tolerances so that a good electrical contact is made therebetween). Conventional plugs and receptacles typically have large contact distances in order to maintain good electrical contact and securement when the plug is placed within the receptacle. In some cases, the contact distances are made large in order to compensate for tolerance variation in the connector dimensions, i.e., a longer contact distance ensures good electrical contact in case the connectors do not fit snuggly. Unfortunately, however, long contact distances typically mean that the friction forces are applied over a longer distance thereby making the connectors difficult to insert and extract, i.e., users have to jam the plug into the receptacle and tug on the plug to remove it from the receptacle.

As shown in FIGS. 2B and 2C, the plug 124 may be extracted and inserted over a wide range of angles A because of the small contact distance D. For example, the plug 124 may be pivoted relative to the receptacle 122 rather than being limited to only axial insertion and extraction. The plug 124 does not have to be pulled out axially, along one axis. In fact, a pivoting action may enable more easy extraction by providing torque or moment to overcome any holding forces.

In order to prevent the plug 124 from sliding out of the receptacle 122 and to ensure proper electrical contact (due to the short axial contact distance), the interface therebetween may include one or more retention mechanisms (not shown in FIG. 2). The retention mechanism may for example include a friction retention coupling located at the mating surfaces of the elements 126 and 128. The friction retention coupling uses friction to hold the elements together. The friction retention coupling may be widely varied. For example, the friction coupling may be provided by dimensioning the insertion element 128 to fit snuggly into the receiving element 126 so that a friction force holds the two together, i.e., resists sliding motion. In addition, the friction coupling may be provided by a biasing member that creates a biasing force against the insertion element 128 (or receiving element 126). The biasing member may for example be a flexure located on the receiving element 126 that exerts a biasing force on the insertion element 128 when the insertion element 128 is positioned within the receiving element 126.

The retention mechanism may also include a holding detent coupling. The holding detent coupling generally consists of two parts, a plug side feature and a receptacle side feature. These two features are cooperatively positioned so that when the plug 124 is inserted, the features engage with one another thus securing the plug 124 to the receptacle 122. The holding detent coupling is typically designed to provide limited holding power. For example, enough holding power to maintain the proper placement of the plug 124 within the receptacle 122 while still allowing a user to overcome it when pulling or pushing the plug 124 into and out of the receptacle 122.

One advantage of the retention mechanisms described above is that the plug 124 is not locked or snapped in thus it may be easily pulled out and pushed into the receptacle 122, i.e., the plug 124 simply slides in and slides out. That is, a user does not have to manipulate a locking feature such as a latch, button, switch, slide, etc.

Figures 3A, 3B:
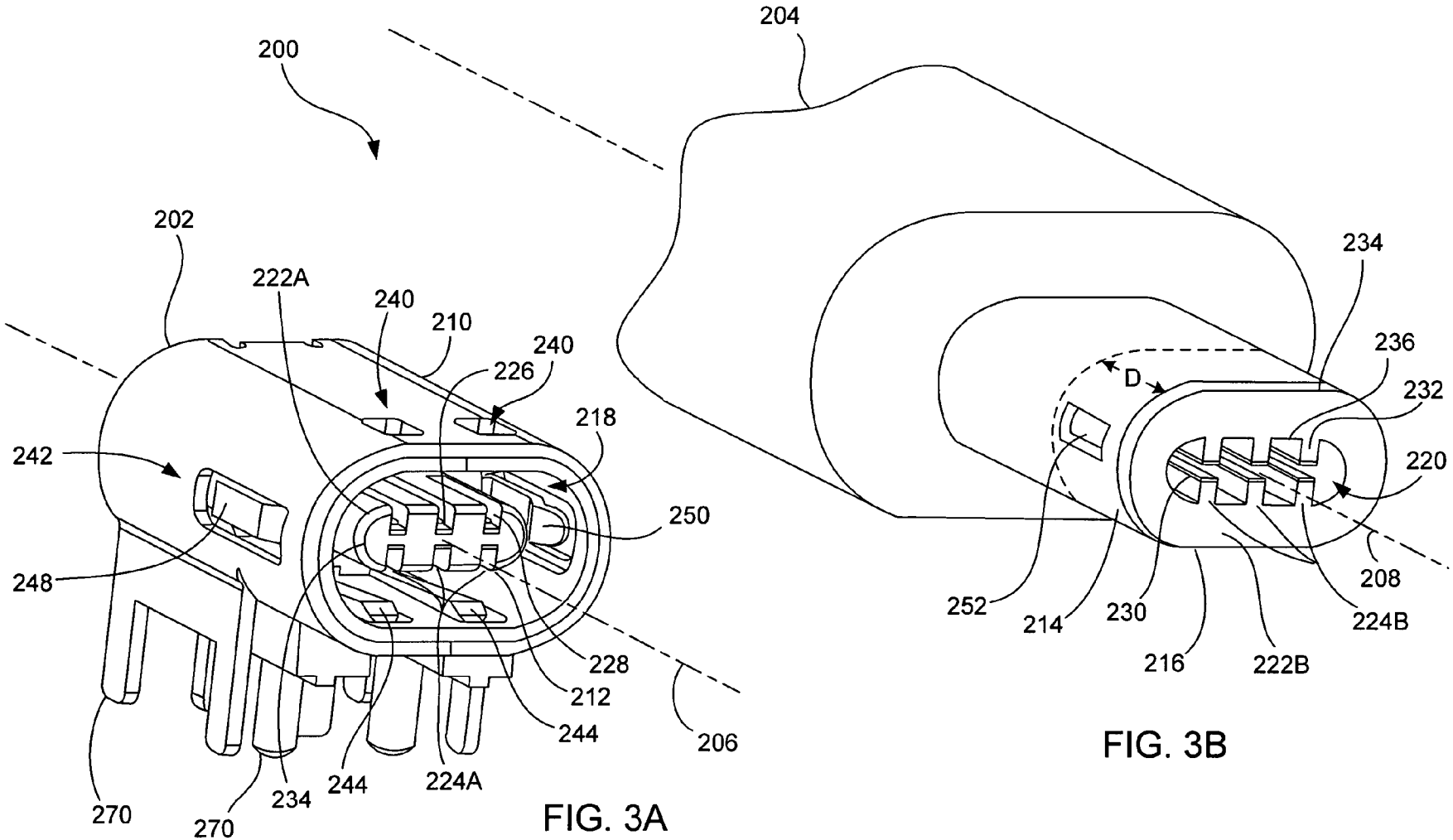
FIG. 3A is a perspective diagram of a DC receptacle, in accordance with one embodiment of the present invention.
FIG. 3B is a perspective diagram of a DC plug, in accordance with one embodiment of the present invention.
Figure 4A:
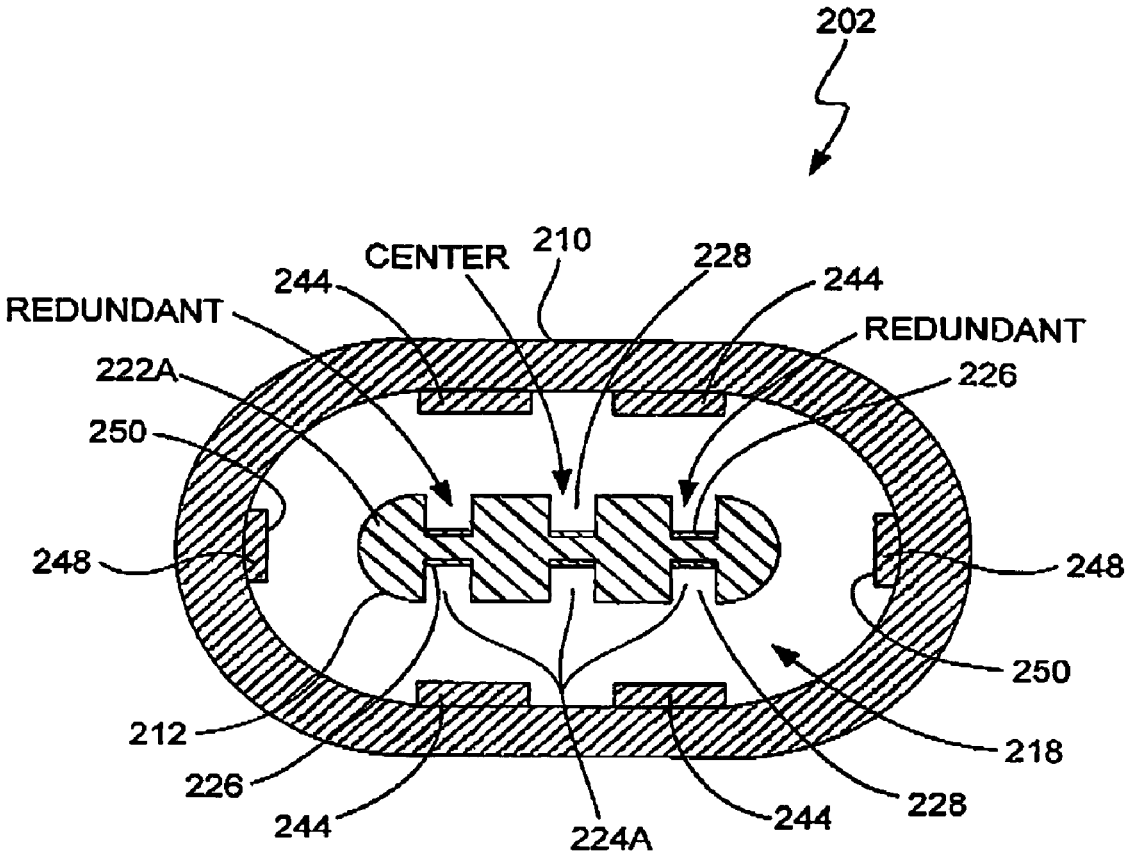
FIG. 4A is a front elevation view, in cross section, of a DC receptacle, in accordance with one embodiment of the present invention.
Figure 4B:
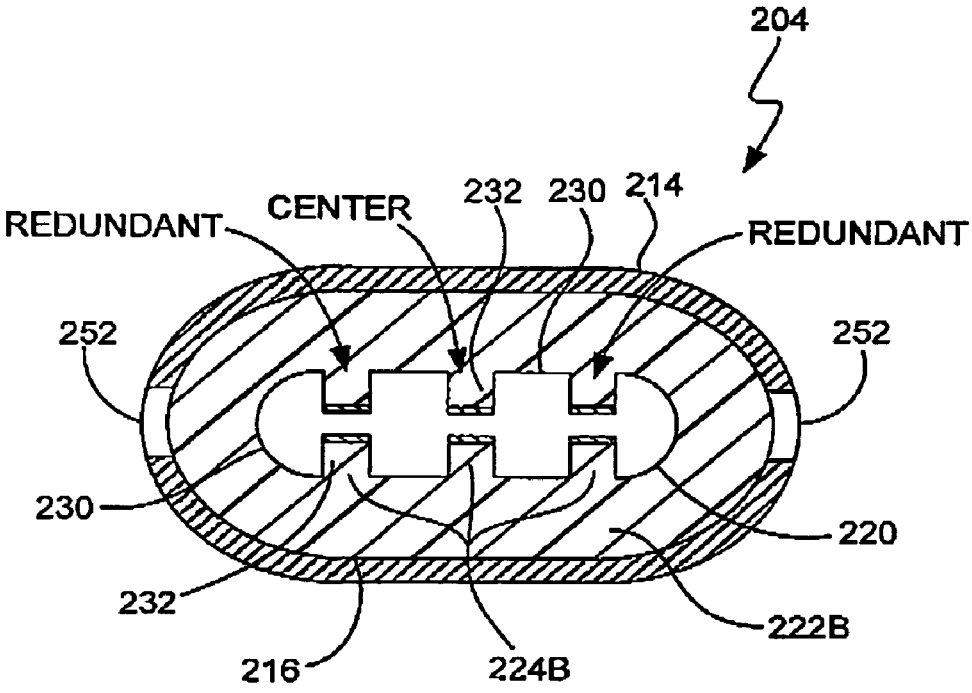
FIG. 4B is a front elevation view, in cross section, of a DC plug, in accordance with one embodiment of the present invention.

Referring to FIGS. 3–4, a DC connector arrangement 200 in accordance with one embodiment will be described. The DC connector arrangement may generally correspond to any of the DC connections described herein. The DC connector arrangement 200 includes a DC plug 204 that can be inserted and extracted into a DC respectable 202 with simplicity, ease and minimal effort. In particular, the DC receptacle and plug are configured to provide 0/180 degree insertion and minimal insertion and extraction forces when coupling and decoupling the plug to and from the receptacle while still providing an adequate retention force for securing the plug to the receptacle during use. FIGS. 3A and 3B are perspective views of a DC receptacle 202 (FIG. 3A) and DC plug 204 (FIG. 3B), respectively. FIGS. 4A and 4B are front elevation views of the DC receptacle 202 and DC plug 204 shown in FIG. 3.

Both the DC plug 204 and DC receptacle 202 extend longitudinally along centerlines 206 and 208, respectively. The DC plug 204 and DC receptacle 202 are configured to mate along their centerlines 206 and 208. That is, when inserted, the centerline 206 of the DC receptacle 202 and centerline 208 of the DC plug 204 are aligned. The DC plug 204 and DC receptacle 202 are configured to be 0/180 symmetrical such that the DC plug 204 can be inserted into the DC plug 202 one of two ways: at 0 and 180 degrees (or some increment thereof, i.e., 180 apart as for example 5 and 185, 90 and 270, etc.). The axial contact distance D between the DC plug 204 and DC receptacle 202 is also minimized to improve the insertion and extraction of the DC plug 204 to and from the DC receptacle 202. This is generally accomplished with non-interlocking mating features that will be described in greater detail below.

As shown, the DC receptacle 202 includes an outer conductive shell 210 and an inner electrode 212. The DC plug 204 also includes an outer conductive shell 214 and an inner electrode 216. The outer conductive shells 210 and 214 and inner electrodes 212 and 216 are configured for mating engagement so as to provide both a mechanical and electrical connection therebetween. These elements have similar cross sectional shapes and sizes so that they fit within one another. The manner in which the outer conductive shells 210 and 214 and inner electrodes 212 and 216 mate is typically inverse, i.e., male/female. Any combination of male/female connections may be used. For example, the DC plug 204 and DC receptacle 202 may include outer conductive shell/inner electrode combinations such as male/male, female/female or male/female. In the illustrated embodiment, the outer conductive shell 214 of the DC plug 204 is dimensioned for sliding receipt within the outer conductive shell 210 of the DC receptacle 202 and the inner electrode 212 of the DC receptacle 202 is dimensioned for sliding receipt within the inner electrode 216 of the DC plug 204. It should be noted, however, that this is not a limitation and that other configurations may be provided. For example, the above mentioned embodiment may be reversed. That is, the outer conductive shell of the DC receptacle may be dimensioned for sliding receipt within the outer conductive shell of the DC plug and the inner electrode of the DC plug may be dimensioned for sliding receipt within the inner electrode of the DC receptacle.

In both the DC plug 204 and DC receptacle 202, the outer conductive shells 210 or 214 and their corresponding inner electrodes 212 or 216 extend longitudinally and are symmetrically placed relative to one another along their centerlines 206 or 208. The inner electrodes 212 and 216 are substantially disposed inside the outer conductive shell within the space provided by the outer conductive shells 210 and 214. In the DC receptacle 202, there is a gap 218 between the outer conductive shell 206 and at least the front portion of the inner electrode 212. That is, the front portion of the inner electrode 212 is spaced apart from the outer conductive shell 210. The gap 218 is configured to receive the outer conductive shell 214 and electrode 216 of the DC plug 204. In the DC plug 204, the inner electrode 216 is placed against the outer conductive shell 214 such that there are no gaps therebetween. The inner electrode 216 of the DC plug 204 does however include an opening 220 for receiving the inner electrode 212 of the DC receptacle 202.

The inner electrodes 212 and 216 of both the DC plug 204 and DC receptacle 202 include an insulating member 222A or 222B and a plurality of exposed contacts 224A or 224B disposed on the insulating member 222A or 222B. The position of the contacts 224 for both the plug 204 and receptacle 202 coincide so that the contacts 224A and 224B engage when the plug 204 is inserted into the receptacle 202. In both the plug 204 and the receptacle 202, the contacts 224 extend longitudinally in parallel with their respective centerlines 26 and 208. The contacts 224 are also laid out in a linear array. That is, the contacts 224 are spaced apart and positioned laterally relative to one another within substantially the same plane (e.g., juxtaposed). At least a center contact 225 is disposed along the centerline 206 or 208. At least a pair of redundant contacts 227 are disposed an equal distance from the centerline 206 or 208 on opposing sides of the centerline 206 or 208. For example, a first redundant contact is positioned on the left side and a second redundant contact is positioned on the right side. Although only one pair of redundant contacts is shown, it should be appreciated that this is not limitation and that more than one pair of redundant contacts may be used. When plural, each set of redundant contacts is spaced further and further from the centerline within the same plane.

The center and redundant contacts may be widely varied. For example, they may correspond to data and/or power contacts. In one embodiment, the center contact 225 is configured for data transmissions while the redundant contacts 227 are configured for power transmissions. The center contact 225 may be configured to transmit data as for example identification data associated with determining the DC requirement of the electronic device. By way of example, the center contact may be operatively coupled to the identification circuit of the power converter shown in FIG. 1. In the illustrated embodiment, the redundant contacts are configured for transmitting the driving current. Because the redundant contacts 227 are placed on both sides of the center contact, they are each capable of transmitting a driving current without having to account for the insertion position of the plug (0 or 180 degrees). In addition to the redundant power contacts of the inner electrode, the outer conductive shells 210 and 214 are also configured for power transmissions, particularly, for grounding purposes. That is, they provide a return path for the driving current. It should be noted that in some cases, the driving and return transmissions may be reversed in the inner electrode and outer conductive shell.

In the DC receptacle 202, each contact 224A includes both upper and lower contact pads 226 that are separated by the insulating member 222A. The contact pads 226A are substantially planar and positioned within upper and lower grooves or channels 228 in the insulating member 222A. In the illustrated embodiment, the substantially planar contacts 226 are positioned at the base of the groove 228. The upper contact pad is connected to the lower contact pad. This may be done proximally, distally or somewhere in between. Each set of contact pads (upper/lower) is connected to a separate terminal or post, each of which is capable of being electrically connected to a PCB.

In the DC plug 204, each contact 224B includes both upper and lower contact pads 230 that are spaced apart from one another (via the opening 220). The contact pads 230 are substantially planar and positioned on rails 232 that protrude from the insulating member 222B. In the illustrated embodiment, the substantially planar contacts pads 230 are positioned at the apex of the rails 232. The rails 232 are generally dimensioned for sliding receipt within the grooves 228 of the inner electrode. The upper contact pad is connected to the lower contact pad. This may be done proximally, distally or somewhere in between. Each set of contact pads (upper/lower) is connected to a separate wire, each of which is capable of being electrically connected to power cables, converters, or sources.

When inserted, the outer conductive shell 214 of the DC plug 204 is mated within the outer conductive shell 210 of the DC receptacle 202 and the inner electrode 212 of the DC receptacle 202 is mated within the inner electrode 216 of the DC plug 204. The mating engagement between these elements produces an electrical connection between the outer conductive shells 210 and 214 and the corresponding contacts 224A and 224B of the inner electrodes 212 and 216. In particular, the rails 232 of the inner electrode 216 mate with the grooves 228 of the inner electrode 212 thus causing the upper and lower contact pads 230 of the DC plug 204 to electrically engage the upper and lower contact pads 226 of the DC receptacle 202. The mating engagement between the outer conductive shells 210 and 214 as well as inner electrodes 212 and 216 also produces a mechanical coupling as for example through a friction coupling at the interface of the outer conductor shells and the inner electrodes. In some cases, the inner electrodes 212 and 216 may include chamfered or tapered edges 234 for helping guide them into their respective gaps or openings. In other cases, the inner electrode 216 may include a generous lead in at its opening for receiving the inner electrode 212 so that the plug 204 and receptacle 202 may be easily engaged when the inner electrode 212 is slid into the inner electrode 216. By way of example, the opening 220 may include a taper or chamfer 236.

In one embodiment, the axial contact distance, D between the outer conductive shells 210 and 214 as well as the contacts 224 of the inner electrodes 212 and 216 is made small compared to conventional connectors. By way of example, the axial contact distance may be between about 2 and about 5 mm and more particularly between about 3 and about 4 mm. Although a certain amount of friction is supplied at the interface between inner electrodes 212 and 216 and outer conductive shells 210 and 214 over the axial contact distance D (snug fit), it may not be enough to ensure proper electrical contact or to hold the plug 204 in the receptacle 202 (at least to an acceptable level). In cases such as these, the DC connection may include one or more retention couplings. For example, the DC connection may include a friction retention coupling 240 and/or a holding detent coupling 242.

The friction retention coupling 240 generally consists of one or more contact flexures 244 for ensuring electrical contact between the outer conductive shells 210 and 214 and providing a biasing force for helping retain the plug 204 within the receptacle 202. The contact flexures 244 are biased inwards towards the centerline 206 by a flexible body such that they extend at least partially into the gap 218 found between the outer conductive shell 210 and the inner electrode 212. They are configured to provide a force on the outer conductive shell 214 of the plug 204 when the plug 204 is inserted into the receptacle 202. This force ensures proper electrical contact between the outer conductive shells. This force also helps secure the plug to the receptacle during use.

The number, position and configuration of the contact flexures 244 may be widely varied. For example, any number of flexures may be used. The number is typically constrained by the size of the flexures, the space available on the outer conductive shell and the desired amount of friction. In the illustrated embodiment, four redundant contact flexures 244 are used. Furthermore, the flexures may be placed at any location on the outer conductive shell including the sides, top or bottom. In most cases, the flexures are placed in an opposed relationship, i.e., located directly across from one another. In the illustrated embodiment, the flexures 244 are placed equally on the top and bottom of the outer conductive shell 210. Furthermore, the flexures may take the form of wires, tabs and the like, and they may be connected to either the plug or the receptacle. In the illustrated embodiment, the contact flexures 244 are a spring loaded tabs (e.g., leaf spring) that are both structurally and electrically connected to the outer conductive shell 210. The spring loaded tabs can be a part of the outer conductive shell (as shown) or they can be separate components attached thereto. The spring loaded tabs are configured to have a contact region for contacting the outer conductive shell 214 of the plug 204 when it is inserted. The size of the contact region is generally determined by the area needed for good electrical contact, the desired amount of friction and the available space on the outer conductive shell 210 of the receptacle 202. The amount of spring force provided by the spring loaded tabs are tunable so as to produce the desired contact force.

The holding detent coupling 242 generally consists of a receptacle-side mating feature that engages a plug-side mating feature. These two features are cooperatively positioned so that when the plug 204 is inserted into the receptacle 202, the features engage with one another thus securing the plug 204 to the receptacle 202. The holding detent coupling 242 is typically designed to provide limited holding power. For example, enough holding power to secure the plug 204 within the receptacle 202 while still allowing a user to pull or push the plug 204 into and out of the receptacle 202. One advantage of this system is that the plug 204 is not locked or snapped in thus it may be easily pulled out and pushed into the receptacle 202, i.e., the plug 204 simply slides in and slides out.

The mating features may be widely varied. In the illustrated embodiment, the receptacle 202 includes one or more holding flexures 248. The holding flexures 248 work similarly to the contact flexures 244 described above. Unlike the contact flexures 244, however, the holding flexures 248 include a detent 250 that springs into recesses 252 positioned on the outer conductive shell 214 of the plug 204. The detents 250 are biased inwards towards the centerline 206 by a flexible body such that they extend into the gap 218 found between the outer conductive shell 210 and the inner electrode 212. The number, position and configuration of the holding flexure/recess may be widely varied (see contact flexures above). In the illustrated embodiment, two holding flexures 248 in the form of spring loaded tabs are placed on opposing sides of the outer conductive shell 210, and two recesses 252 are placed on opposing sides of the outer conductive shell 214. The position where the detents 250 mate with the recess 252 generally coincides with the axial contact distance, D.

When the plug 204 is pushed into the receptacle 202, the outer conductive shell 214 of the plug 204 engages both the contact flexures 244 and the holding flexures 248. Because the flexures 244 and 248 flex, they allow the outer conductive shell 216 to move inward within the outer conductive shell 210 when pushed in by a user, i.e., the flexures 244 and 248 bend outwards away from the centerline 206. When bent, the flexures 244 and 248 exert a force on the outer conductive shell 214, which helps secure the plug 204 to the receptacle 202 as well as ensure proper electrical contact between the outer conductive shells 210 and 214. Upon further insertion, the recesses 252 of the outer conductive shell 214 meet up with the detents 250 of the holding flexure 248 located on the outer conductive shell 210. When the detents 250 and recesses 252 are fully engaged, the holding flexures 248 resume their natural position (bend back towards the centerline 206) thereby trapping the detents 250 within the recess 252. Using this arrangement, the plug 204 is prevented from sliding out of the receptacle 202 on its own. The force is generally configured for holding the plug in the receptacle during normal use. In order to remove the plug 204, a user simply pulls on the plug 204. During the pulling action, the detents 250 slide against the edges of the recesses 252. When a significant pulling force has been provided, the holding flexures 248 flex thereby releasing the detents 250 from the recesses 252. Using this arrangement, the user simply has to overcome the spring bias at the detent/recess interface and the friction force caused by the flexures 244 and 248 when sliding the plug 204 in and out of the receptacle 202.

Figure 5A:
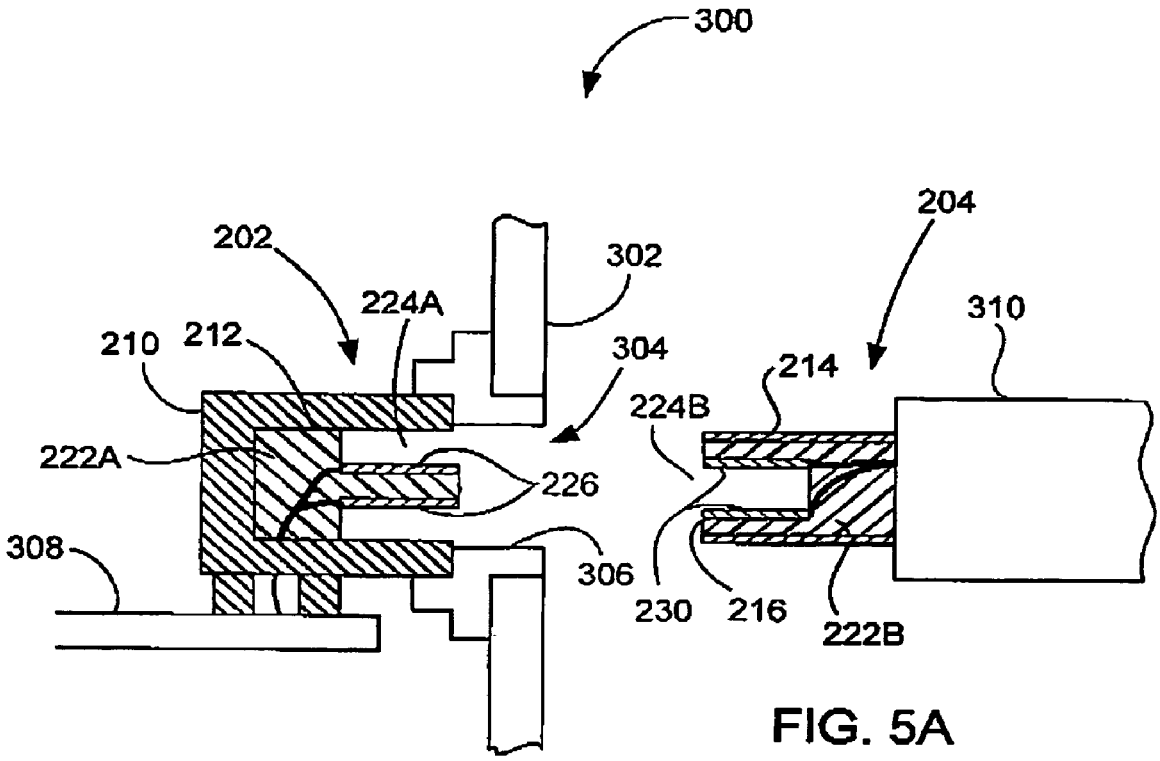
FIGS. 5A and 5B are side elevation views, in cross section, of a DC connector arrangement in accordance with one embodiment of the present invention.
Figure 5B:
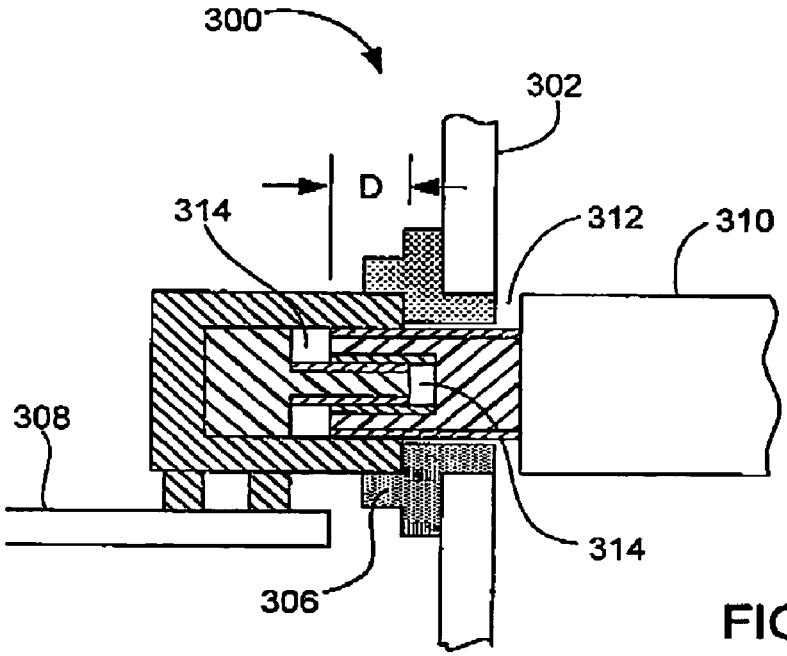

In order to connect the DC receptacle within a housing, the DC receptacle 202 generally includes one or more posts 270. The posts 270 may be integral with the outer conductive shell 210 and/or the inner electrode 212. If the later, the post(s) 270 may protrude through an opening in the outer conductive shell 210. In either case, the posts 270 may serve as structural members as well as a means for providing electrical connection to the internal components positioned in the housing as for example a printed circuit board (PCB). The posts of the inner electrode 212 may be a portion of the insulating member 222A. As such, the post mat include a wire embedded therein for connecting the contact pads to the PCB FIGS. 5A and 5B are side elevation views, in cross section, of the DC arrangement 200. The cross section is taken substantially along the centerlines 206 and 208 in a direction perpendicular to the linear array. The connector arrangement 200 includes a DC receptacle 202 and a DC plug 204 as described above. As stated previously, the DC receptacle 202 includes an outer conductive shell 210 and an inner electrode 212. The inner electrode 212 includes an insulating member 222A and contacts 224A disposed therein. The contacts 224A are formed by upper and lower contact pads 226 positioned in grooves 228 of the insulating member 222A. Furthermore, the DC plug 204 includes an outer conductive shell 214 and an inner electrode 216. The inner electrode 216 includes an insulating member 222B and contacts 224B disposed therein. The contacts 224B are formed by upper and lower contact pads 230 positioned on rails 232 of the insulating member 222B.

In this particular illustration, the DC receptacle 202 is assembled in an electronic device 300. The DC receptacle 202 is enclosed within a device housing 302. The device housing 302 includes an opening 304 and a support member 306 for supporting the receptacle 202 next to the opening 304. The opening 304 allows access for insertion of the plug 204 into the receptacle 202. The support member 306 may be integrally formed with the device housing 300 or it may be a separate component. The receptacle 202 is attached to a printed circuit board 308 such as a motherboard of a laptop computer. The connection to the PCB allows the electrode contacts 224 to electrically couple to various circuit components as for example a power management circuit. The DC plug 204, on the other hand, includes its own enclosure 310, which may structurally couple to a cable and allow for electrical connection between the contacts 224 and the wires of the cable.

Referring to FIG. 5B, when the plug 204 is inserted into the receptacle 202, the outer electrodes 210 and 214 come into contact thereby ensuring an electrical connection. Furthermore, the inner electrodes 212 and 216 mate thus ensuring electrical connection between the corresponding contacts 224A and B, i.e., the upper contact pads contact each other and the lower contact pads contact each other. As shown, the insertion of the outer conductive shells 210 and 214 and inner electrodes 212 and 216 into one another occurs axially along their centerlines 206 and 208 over the axial contact distance D. Although its generally preferred to have the plug enclosure 310 abut the outer surface of the housing 302 while maintaining the axial contact distance D, the length of the DC plug 204 may be dimensioned to provide a tolerance gap 312 between the plug enclosure 310 and the outer surface of the device housing 302. Tolerance gaps 314 may also be provided between the inner electrodes 312 and 314.

The method of manufacture and materials used to produce the DC arrangement may be widely varied. By way of example, the outer conductive shells may be formed from sheet metals such as steel or copper. In some cases, the sheet metals may be plated in order to increase surface hardness and electrical conductivity. For example, the nickel-plated steel may be used. The desired shape including cut outs, flexures, posts, etc. of the outer conductive shell are formed using conventional techniques such as stamping. The sheets may include more than one layer. In fact, in one embodiment, the outer conductive shell 210 is formed from two layers 211A and 211B. As shown, in FIGS. 3A and 4A, the seams for each layer are placed in an opposed relationship to provide greater rigidity to the structure. Furthermore, the flexures may be formed from both layers, or from only one layer. For example, the flexures may be formed in the inner layer 211B.

The insulating members may be molded from various dielectric materials including plastics such as ABS and/or nylon. In some cases, the plastics may be glass filled to increase the durability and robustness of the insulating member. The insulating members are typically injection molded parts. Once molded, the contact pads can be positioned thereon. Alternatively, the contact pads and wires associated therewith are molded with the insulating member such that they are embedded in the insulating member. The insulating member is typically press fit into the outer conductive shells.

Figure 6:
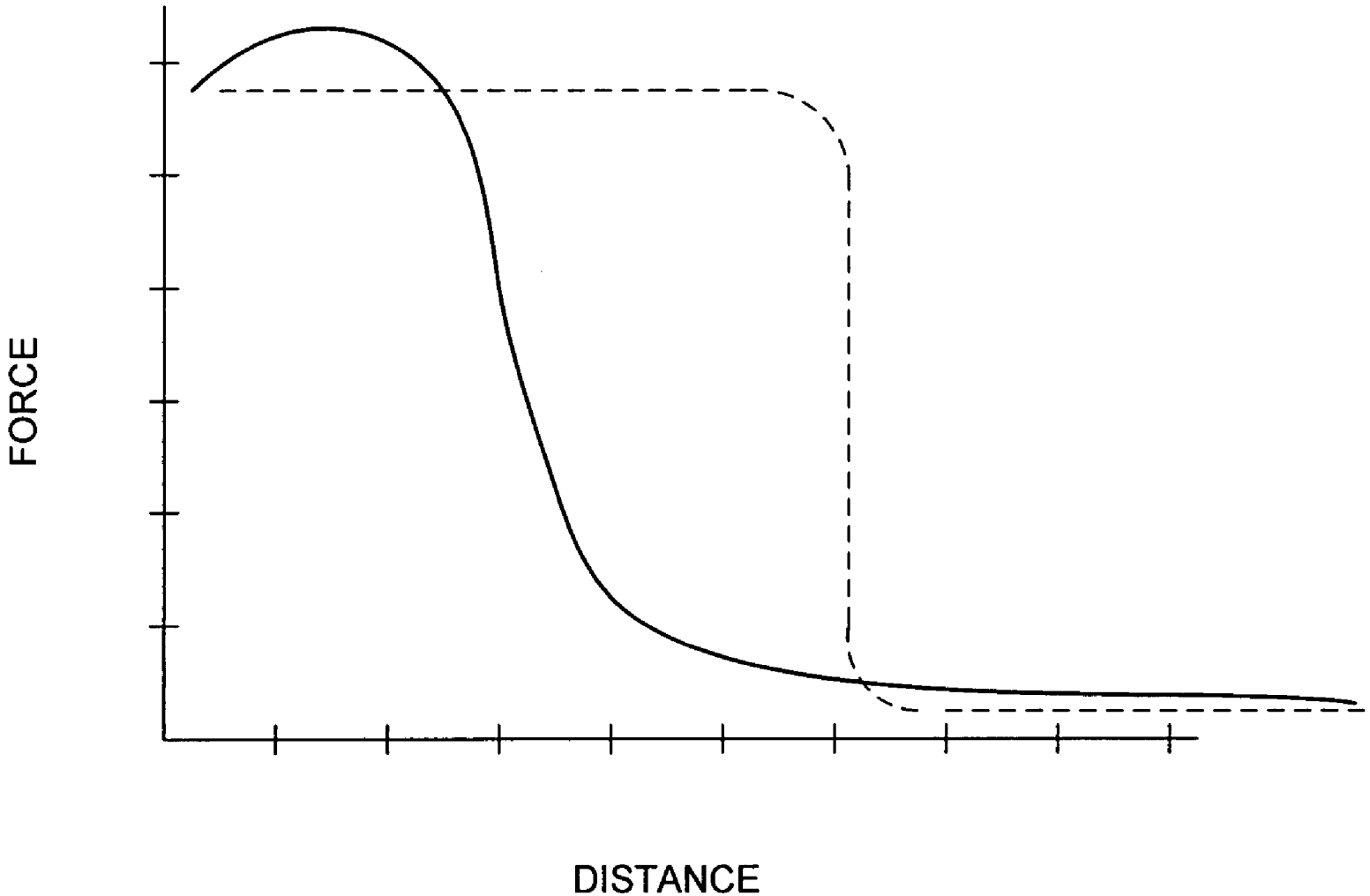
FIG. 6 is diagram comparing conventional coaxial DC connectors with the DC connector of the present invention.

FIG. 6 is an exemplary diagram comparing a conventional coaxial DC connector arrangement (shown by a dotted line) with the DC connector arrangement disclosed herein (shown by a solid line). As shown, insertion and extraction is easier with the DC connector of the present invention because the friction force is applied over a shorter distance than the conventional coaxial DC connector.

The advantages of the invention are numerous. Different embodiments or implementations may have one or more of the following advantages. One advantage of the invention is that DC connections can be made at more than one position thus making it easier for the user to make a connection therebetween. The user simply inserts the plug into the receptacle without having to think about its orientation relative to the receptacle. Another advantage of the invention is that the insertion and extraction forces between the plug and the receptacle have been significantly reduced thus making it easier to couple and decouple the DC connectors. Another advantage of the invention is that the plug can be inserted and extracted at more severe angles relative to the centerline of the receptacle without exponentially increasing the friction force. Another advantage of the invention is that the resulting DC connector conveys a higher quality impression to users. That is, the cosmetic appearance has not been compromised.

While this invention has been described in terms of several preferred embodiments, there are alterations, permutations, and equivalents, which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. A DC connector, comprising:

a conductive outer shell; and an inner electrode disposed within the outer shell, the inner electrode having redundant power contacts electrically isolated within the same plane, the redundant power contacts being laterally spaced apart equally relative to a central axis, the outer shell and inner electrode being configured for 0/180 degree connection with a second outer shell and second inner electrode of a second DC connector along a mating axis, the outer shell and inner electrode of the DC connector having an axial contact distance with the second outer shell and second inner electrode of the second DC connector of less than 5 mm when fully mated so as to minimize the mating force between the DC connectors, and to allow angled insertion and extraction away from the mating axis during the 0/180 connection with the second DC connector.

2. The DC connector as recited in claim 1 wherein the axial contact distance is between about 3 and about 4 mm.

3. The DC connector as recited in claim 1 wherein the axial contact distance is achieved without using locking mechanisms.

4. The DC connector as recited in claim 1 wherein the axial contact distance is achieved with a retention mechanism found between the first and second DC connectors.

5. The DC connector as recited in claim 1 wherein the height of the DC connector is smaller than the width of the DC connector.

6. The DC connector as recited in claim 1 wherein the axial contact distance is achieved at least in part by placing an end of the redundant power contacts at a mating end of the inner electrode.

7. The DC connector as recited in claim 1 wherein the outer shell is configured for a first power line of the DC connector and the redundant power contacts are configured for a second power line of the DC connector, the outer shells electrically mating with one another at 0 and 180 degrees in order to establish a first power line therethrough, the redundant power contacts of the inner electrodes electrically mating with one another at 0 and 180 degrees in order to establish a second power line therethrough.

8. The DC connector as recited in claim 1 wherein the same functionality is provided by the connector when the outer shells and inner electrodes are connected at 0 degrees and 180 degree.

9. A DC connector arrangement having a signal line, a first power line, and a second power line, the DC connector arrangement comprising:

a DC receptacle comprising:

an outer conductor; and an inner electrode disposed within the outer conductor;

a DC plug for insertion into the DC receptacle at only 0 and 180 degrees, the DC plug comprising:

an outer conductor that electrically mates with the outer conductor of the DC receptacle in both the 0 and 180 degree orientations; and an inner electrode disposed within the outer conductor and that electrically mates with the inner electrode of the DC receptacle in both the 0 and 180 degree orientations, wherein the inner electrodes of both the DC plug and DC receptacle include juxtaposed contacts, the juxtaposed contacts including a single center signal contact and first and second lateral redundant power contacts that are equally spaced from the center signal contact and positioned in their entirety on opposing sides of the center signal contact, the center signal contacts being configured to transmit signals, the first and second lateral redundant power contacts being configured to transmit DC power, and wherein the center signal contact of the DC plug mates with the center signal contact of the DC receptacle in both the 0 and 180 degree orientations in order to establish the only signal line of the DC connector arrangement, and wherein the first lateral redundant power contact of the inner electrode of the DC plug mates with the first lateral redundant power contact of the inner electrode of the DC receptacle and the second lateral redundant power contact of the inner electrode of the DC plug mates with the second lateral redundant power contact of the inner electrode of the DC receptacle in the 0 degree orientation in order to establish the first power line of the DC connector arrangement, and wherein the first lateral redundant power contact of the inner electrode of the DC plug mates with the second lateral redundant power contact of the inner electrode of the DC receptacle and the second lateral redundant power contact of the inner electrode of the DC plug mates with the first lateral redundant power contact of the inner electrode of the DC receptacle in the 180 degree orientation in order to establish the first power line of the DC connector arrangement, and wherein the outer shell of to DC plug mates with the outer shell of the DC receptacle in both the 0 and 180 degree orientations in order to establish the second power line of the DC connector arrangement.

10. The DC connector arrangement as recited in claim 9 wherein each of the contacts includes an upper contact surface and a lower contact surface.

11. The DC connector arrangement as recited in claim 9 wherein the outer conductive shell of the DC plug fits into the outer conductive shell of the DC receptacle, and wherein the inner electrode of the DC receptacle fits into the inner electrode of the DC plug.

12. The DC connector arrangement as recited in claim 9 wherein the inner electrode of the DC receptacle includes an insulator, the insulator including a plurality of grooves within which the center and lateral contacts reside and wherein the inner electrode of the DC plug includes an insulator, the insulator including a plurality of rails containing the center and lateral contacts, the rails of the DC plug sliding in and mating with the corresponding grooves of the DC receptacle when the DC plug is mated with the DC receptacle so that the center and lateral contacts of the DC plug electrically engage the center and lateral contacts of the DC receptacle.

13. The DC connector arrangement as recited in claim 12 wherein each of the juxtaposed contacts includes an upper contact and a lower contact that are electrically connected in order to form one of the contacts of the juxtaposed contacts and wherein the insulator of the DC receptacle includes an upper groove for each of the upper contacts and a lower groove for each of the lower contacts, and wherein the insulator of the DC plug includes an upper rail for each of the upper contacts and a lower rail for each of the lower contacts.

14. The DC connector arrangement as recited in claim 12 wherein the contacts of the DC receptacle are coupled to a PCB via wires embedded in the insulating member, and the outer conductor of the DC receptacle is coupled to the PCB via legs or posts that extend out the bottom of the outer conductive shell.

15. The DC connector arrangement as recited in claim 12 wherein the ends of the center and lateral contacts extend to the ends of the grooves at a mating end of the inner electrode of the DC receptacle, and wherein the ends of the center and lateral contacts extend to the ends of the rails at the mating end of the rails of the inner electrode of the DC plug.

16. The DC connector arrangement as recited in claim 9 wherein the outer conductive shell of the DC receptacle includes a holding flexure, and wherein the outer conductive shell of the DC plug includes a recess for receiving a detent of the holding flexure in order to help secure the DC plug to the DC receptacle.

17. The DC connector arrangement as recited in claim 16 wherein the outer conductive shell of the DC receptacle includes a pair of holding flexures in an opposed relationship on the sides of the outer conductive shell of the DC receptacle, and wherein the outer conductive shell of the DC plug a pair of recesses in an opposed relationship on the sides of the outer conductive shell of the DC plug, the holding flexures having detects that are configured to spring into the recesses when the DC plug is mated with the DC receptacle in order to help secure the DC plug to the DC receptacle.

18. The DC connector arrangement as recited in claim 9 wherein the outer conductive shell of the DC receptacle includes one or more ground flexures for making electrical contact with the outer conductive shell of the DC plug.

19. The DC connector arrangement as recited in claim 18 wherein the outer conductive shell of the DC receptacle includes a pair ground flexures at the top of the outer conductive shell and a pair of ground flexures at the bottom of the outer conductive shell.

20. The DC connector arrangement as recited in claim 9 wherein the center signal contacts are configured to transmit an identification signal associated with determining the DC requirement of an electronic device, wherein the redundant power contacts are configured to transmit a driving current, and wherein the outer conductors are configured to transmit a return current.

21. The DC connector arrangement as recited in claim 20 wherein the DC receptacle is coupled to an electronic device, and wherein the DC plug is coupled to a power adapter configured to receive AC power and output DC power for transmission through the DC plug, the power adapter including a power convener that converts the source AC power into DC power required for operating or charging the electronic device, the power converter including an identification circuit that communicates with the electronic device through the center contact in order to determine the DC requirement of the electronic device.

22. A DC connector arrangement comprising:

a DC receptacle having an outer shell and an inner electrode disposed within the outer shell:

a DC plug insertable into the DC receptacle, the DC plug having an outer shell that mates with the outer shell of the DC receptacle and an inner electrode that mates with the inner electrode of the DC receptacle, the outer shells forming a first power line of the DC connector arrangement when mated, the inner electrodes forming a second power line of the DC connector arrangement when mated;

a holding detent mechanism located between the DC receptacle and DC plug, the holding detent mechanism minimizing the distance the plug has to travel relative to the receptacle at the friction force required to hold the plug in the receptacle during normal use; and one or more contact flexures for ensuring electrical contact between the DC receptacle and the DC plug.

23. The DC connector arrangement as recited in claim 22 wherein the holding detent mechanism provides enough holding power to maintain the proper placement of the DC plug within the DC receptacle while still allowing a user to overcome it when inserting and extracting the DC plug to and from the DC receptacle.

24. The DC connector arrangement as recited in claim 22 wherein the holding detent mechanism includes a pair of holding flexures in an opposed relationship on the sides of the DC receptacle and a pair of recesses in an opposed relationship on the sides of the DC plug, the holding flexures having detents that are configured to spring into the recesses when the DC plug is mated with the DC receptacle in order to help secure the DC plug to the DC receptacle, andwherein the DC receptacle includes a first pair of contact flexures on the top of the DC receptacle and a second pair of contact flexures on the bottom of the DC receptacle, the first and second pairs of contact flexures being in opposed relationship.

25. The DC connector arrangement as recited in claim 22 wherein the inner electrodes of both the DC plug and DC receptacle include juxtaposed contacts, the juxtaposed contacts including a center contact and lateral redundant contacts that are equally spaced from the center contact, the center contact of the DC plug being configured to mate with the center contact of the DC receptacle, the lateral redundant contacts of the DC plug being configured to mate with either of the lateral redundant contacts of the inner electrode of the DC receptacle, the lateral redundant contacts of the DC receptacle and DC plug providing the same functionality such that the DC connector arrangement is operational in multiple orientations.

26. The DC connector arrangement of claim 22 wherein an outer perimeter of the outer shell of the DC plug is dimensioned to coincide with an inner perimeter of the outer shell of the DC receptacle, and wherein an outer perimeter of the inner electrode of the DC receptacle is dimensioned to coincide with an inner perimeter of the inner electrode of the DC plug.

27. The DC connector arrangement of claim 22 wherein the outer shells are formed from an electrically conductive material, a receiving end of the inner electrode of the DC receptacle is spatially separated from the inside surface of the outer shell of the DC receptacle thereby forming a void between the outer shell and the inner electrode of the DC receptacle, the receiving end of the inner electrode of the DC receptacle comprising an insulator body and plurality of juxtaposed conductive contacts on the outside of the insulator body, the inner electrode of the DC plug comprising an insulator body and a plurality of juxtaposed conductive contacts disposed on an inside surface of an opening of the insulator body, the insulator body of the DC receptacle fitting within the opening of the insulator body of the DC plug so that the conductive contacts can engage one another thereby forming the second power line of the DC connector arrangement, the outer shell and insulator body of the DC plug fitting within the void found between the outer shell and the inner electrode of the DC receptacle so that the outer shells can engage one another thereby forming the first power line of the DC connector arrangement.

28. The DC connector arrangement as recited in claim 22 wherein the DC plug is insertable at two positions while maintaining the first and second power lines of the DC connector arrangement.

29. The DC connector arrangement as recited in claim 22 wherein the holding detent mechanism includes a plug side feature and a receptacle feature that are cooperatively positioned so that when the DC plug is inserted into the DC receptacle, the feature engage thus securing the DC plug to the DC receptacle.

30. The DC connector arrangement as recited in claim 29 wherein the DC receptacle includes one or more holding flexures, each of the holding flexures including a detent that springs into a corresponding recess of the DC plug.

31. A DC connector arrangement, comprising:

a DC receptacle comprising:

an outer conductor formed from two conductive layers, and wherein the seams for each layer are placed in an opposed relationship to provide greater rigidity to the outer conductor; and an inner electrode disposed within the outer conductor a DC plug for insertion into the DC receptacle at only 0 and 180 degrees, the DC plug comprising:

an outer conductor that electrically mates with the outer conductor of the DC receptacle in both the 0 and 180 degree orientations; and an inner electrode disposed within the outer conductor and that electrically mates with the inner electrode of the DC receptacle in both the 0 and 180 degree orientations, wherein the inner electrodes of both the DC plug and DC receptacle include juxtaposed contacts, the juxtaposed contacts including a center contact and first and second lateral redundant contacts that are equally spared from the center contact and positioned in their entirety on opposing sides of the center contact, the center contacts being configured to transmit data signals, the first and second lateral redundant contacts being configured to transmit DC power, and wherein the center contact of the DC plug mates with the center contact of the DC receptacle in both the 0 and 180 degree orientations, and wherein the first lateral redundant contact of the inner electrode of the DC plug mates with the first lateral redundant contact of the inner electrode of the DC receptacle and the second lateral redundant contact of the inner electrode of the DC plug mates with the second lateral redundant contact of the inner electrode of the DC receptacle in the 0 degree orientation, and wherein the first lateral redundant contact of the inner electrode of the DC plug mates with the second lateral redundant contact of the inner electrode of the DC receptacle and the second lateral redundant contact of the inner electrode of the DC plug mates with the first lateral redundant contact of the inner electrode of the DC receptacle in the 180 degree orientation.

32. A low profile DC connector dedicated to transmitting DC power to a high powered electronic device, the low profile connector being configured for only 0/180 engagement while providing the same DC power transmission from both positions, the low profile DC connector including a planar inner electrode and a conductive outer shell surrounding the periphery of the planar inner electrode, the planar inner electrode having redundant power contacts positioned on opposite sides and at equal distances from a central axis of the inner electrode, the redundant contacts forming a driving line for the low profile DC connector, the conductive outer shell having an annular shape with width greater than a height, the outer conductive shell forming a return line for the low profile DC connector.

33. The low profile DC connector as recited in claim 32 wherein the high powered electronic device is a laptop computer.

34. The low profile DC connector as recited in claim 32 wherein the redundant contacts are configured to transmit a voltage greater than 12 volts.

35. The low profile DC connector as recited in claim 32 wherein the redundant contacts are configured to transmit a voltage of about 24.5 volts.

* * * * *

UNITED STATES PATENT AND TRADEMARK OFFICE

CERTIFICATE OF CORRECTION

PATENT NO. : 7,094,089 B2
APPLICATION NO. : 10/799403
DATED : August 22, 2006
INVENTOR(S) : Andre et al.

It is certified that error appears in the above-identified patent and that said Letters Patent is hereby corrected as shown below:

In the Claims:

Column 15, line 40 change “of to” to --of the--.

Column 16, line 57 change “convener” to --converter--.

Column 18, line 42 change “spared” to --spaced--.

Signed and Sealed this

Seventh Day of August, 2007

JON W. DUDAS
*Director of the United States Patent and Trademark Office*